US005772012A

United States Patent [19]

D'Muhala

[11] Patent Number: 5,772,012

[45] Date of Patent: Jun. 30, 1998

[54] FLEXIBLE DECONTAMINATION APPARATUS

[75] Inventor: Thomas F. D'Muhala, Raleigh, N.C.

[73] Assignee: Corpex Technologies, Inc., Durham, N.C.

[21] Appl. No.: 646,768

[22] Filed: May 8, 1996

[51] Int. Cl.[6] ..... C25F 3/00

[52] U.S. Cl. ..... 204/224 R; 204/257; 204/271

[58] Field of Search ..... 204/257, 271, 204/224 R

[56] References Cited

U.S. PATENT DOCUMENTS

| | | | |
|---|---|---|---|
| 3,294,664 | 12/1966 | Franklin | 204/224 |
| 3,354,873 | 11/1967 | Williams, Jr. et al. | 204/224 R |
| 3,546,088 | 12/1970 | Barkman et al. | 204/224 |
| 3,751,343 | 8/1973 | Macula et al. | 204/224 |
| 3,779,887 | 12/1973 | Gildone | 204/224 |
| 4,001,094 | 1/1977 | Jumer | 204/129.6 |
| 4,002,456 | 1/1977 | Maas | 71/3 |
| 4,014,773 | 3/1977 | Furuya | 204/206 |
| 4,190,513 | 2/1980 | Jumer | 204/224 R |
| 4,217,192 | 8/1980 | Lerch et al. | 204/149 |
| 4,304,654 | 12/1981 | Norris | 204/212 |
| 4,318,786 | 3/1982 | Lahoda et al. | 204/141.5 |
| 4,421,556 | 12/1983 | Windt et al. | 75/63 |
| 4,431,501 | 2/1984 | Leppänen | 204/224 R |
| 4,587,043 | 5/1986 | Murray et al. | 252/626 |
| 4,632,740 | 12/1986 | Operschall et al. | 204/129.46 |
| 4,776,933 | 10/1988 | Ruhstrofer et al. | 204/129.7 |
| 4,777,971 | 10/1988 | Tribout et al. | 134/99 |
| 4,810,343 | 3/1989 | Bonnardel | 204/224 R |
| 4,988,414 | 1/1991 | Westerman, Jr. | 204/15 |
| 5,135,632 | 8/1992 | Weber | 204/224 M |

OTHER PUBLICATIONS

Zurer; Powerful New Metal–Chelating Agents Developed; *C&EN* (Aug. 1, 1988), pp. 21–22.

*Primary Examiner*—Kathryn L. Gorgos
*Assistant Examiner*—Chrisman D. Carroll
*Attorney, Agent, or Firm*—Myers Bigel Sibley & Sajovec

[57] ABSTRACT

An apparatus is configured with first and second applicators for applying respective first and second electrolytic fluids. Decontaminating a surface comprises supplying a first electrolytic fluid to a first applicator, supplying a second electrolytic fluid to a second applicator, generating an electrical potential between the first and second applicators, and contacting the contaminated surface with the first and second applicators.

49 Claims, 3 Drawing Sheets

FLEXIBLE DECONTAMINATION APPARATUS

FIELD OF THE INVENTION

The present invention relates to decontaminating surfaces, and more particularly to the decontamination of surfaces contaminated with radioactive materials.

BACKGROUND OF THE INVENTION

In a nuclear power plant, various types of equipment, including piping, vessels, pumps, valves, and the like, are exposed to radioactive contamination. Process equipment used in various petrochemical plants, refineries, and the like are exposed to naturally occurring radioactive material ("NORM"). NORM is present in varying concentrations in ground water, in oil and gas production wells, and in by-products from various mining operations. Before maintenance can be performed on equipment contaminated with radioactive material, removal of any radioactive contamination is typically required.

Currently available decontamination methods can be broadly classified under two categories: mechanical and chemical. Commonly used mechanical decontamination methods include vacuum cleaning, hydroblasting, sandblasting, blasting with other abrasives, flame cleaning, scraping, and scabbling. Unfortunately, the mechanical decontamination methods currently available have several drawbacks. The mechanical methods involving sandblasting, scraping, and other methods of surface removal typically result in radioactive material being dispersed into the air, thus presenting an additional hazard to personnel. Many of the mechanical methods are labor intensive, thus increasing both the cost of decontamination and the personnel exposure time. Additionally, the complexity of many surface contours and shapes often renders decontamination by mechanical means difficult or impractical.

Commonly used chemical decontamination methods include water washing, steam cleaning, and scrubbing with detergents, acids, caustics, and solvents. See for example, U.S. Pat. No. 4,537,666 to Murray et al. Unfortunately, conventional chemical decontamination methods, such as that described by Murray et al., often require long treatment times to adequately decontaminate a surface, because of slow ion exchange rates. Chemical decontamination methods often require the chemical solutions to be applied at an elevated temperature, thus increasing the complexity and cost.

SUMMARY OF THE INVENTION

It is therefore an object of the present invention to provide systems and apparatus for quickly and inexpensively removing contamination from a variety of surfaces, including those having complex contours and shapes.

It is yet another object of the present invention to provide systems and apparatus for decontaminating surfaces wherein the contamination is not dispersed into the air.

It is yet another object of the present invention to provide a decontamination apparatus that is portable and easy to use.

These and other objects are provided, according to the present invention, by an electrolytic sponge applicator for decontaminating surfaces comprising multiple pairs of first and second applicators separated by an insulating member. Each pair of applicators is configured to receive and transfer respective first and second electrolytic fluids to a contaminated surface. The applicators are formed of a material permeable by the electrolytic fluids and have an internal bore configured to receive electrolytic fluid from a tube inserted therein. The electrolytic fluids may receive their respective positive and negative charges either from electrodes in contact with the applicators, or from electrodes in contact with the electrolytic fluid delivery system.

The electrolytic sponge applicator, according to the present invention, is advantageous for a variety of reasons. A variety of surfaces, including those having irregular contours, surface textures, and materials (both conductive and non-conductive), can be easily decontaminated. Temperature is not an important parameter; decontamination can be performed rapidly with the present invention at virtually any temperature, even below freezing when used with an appropriate anti-freeze solution.

The applicator uses very little liquid, making it quite efficient and useful for vertical surfaces and other surfaces which cannot tolerate flooding, bathing, spraying, or other large quantities of liquid. The applicator functions well for decontaminating isolated areas or hot spots without subjecting adjacent areas to the decontamination process and chemicals. Because of the minimal liquid required, the applicator minimizes the final waste volume produced. Also, the applicator is advantageous because it does not contribute to airborne activity.

DETAILED DESCRIPTION OF PREFERRED EMBODIMENTS

The present invention now is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1A:
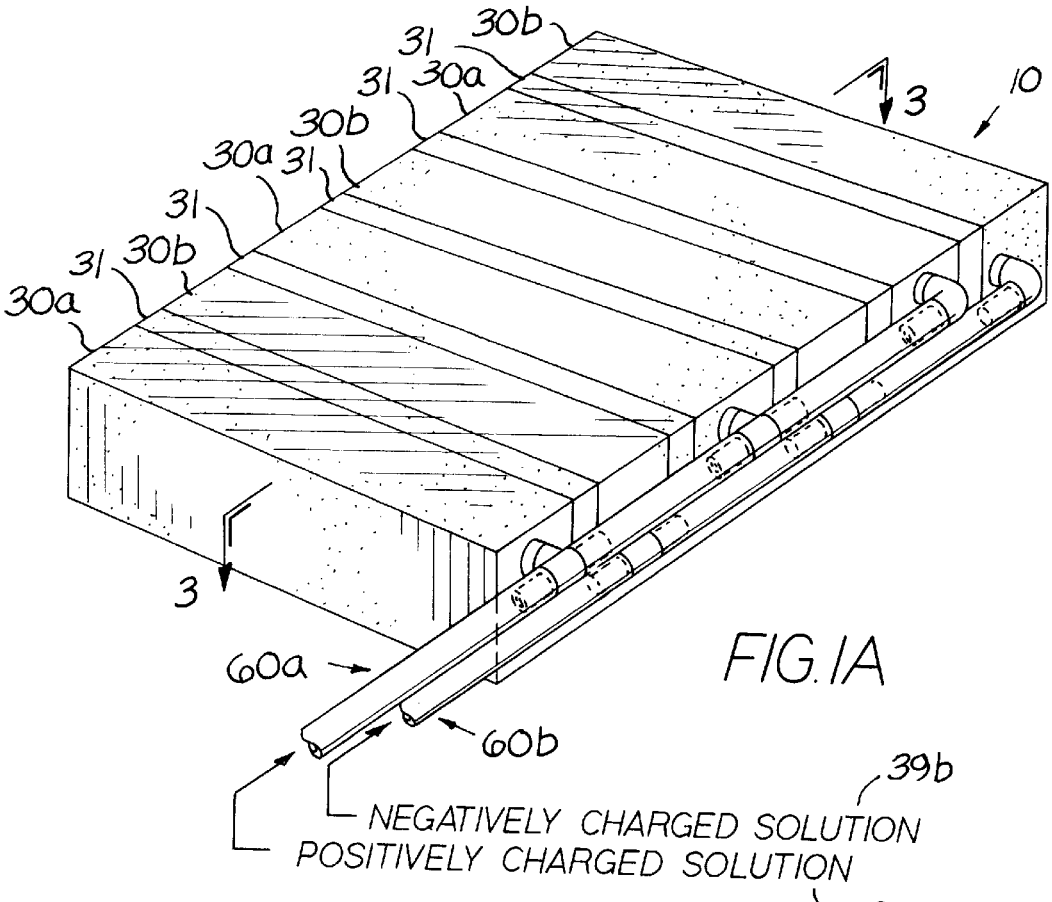
FIG. 1A illustrates an apparatus for decontaminating surfaces, according to one aspect of the present invention.

Referring now to FIG. 1A, an apparatus 10 for decontaminating surfaces having either loose (smearable) surface contamination or fixed, adherent contamination (e.g., radionuclides that have become part of, or entrapped by, other deposits or oxide film) thereon, according to the present invention, is illustrated. The apparatus 10 generally comprises a plurality of pairs of first and second applicators 30*a*,30*b*, and first and second fluid manifolds 60*a*,60*b*. The first and second applicators 30*a*,30*b* in each pair are separated by a non-conductive divider 31. In addition, means for applying a positive and negative charge (polarity) to each respective fluid stream flowing through the first and second fluid manifolds 60*a*,60*b* are illustrated in FIGS. 1B and 1C.

Figure 1B:
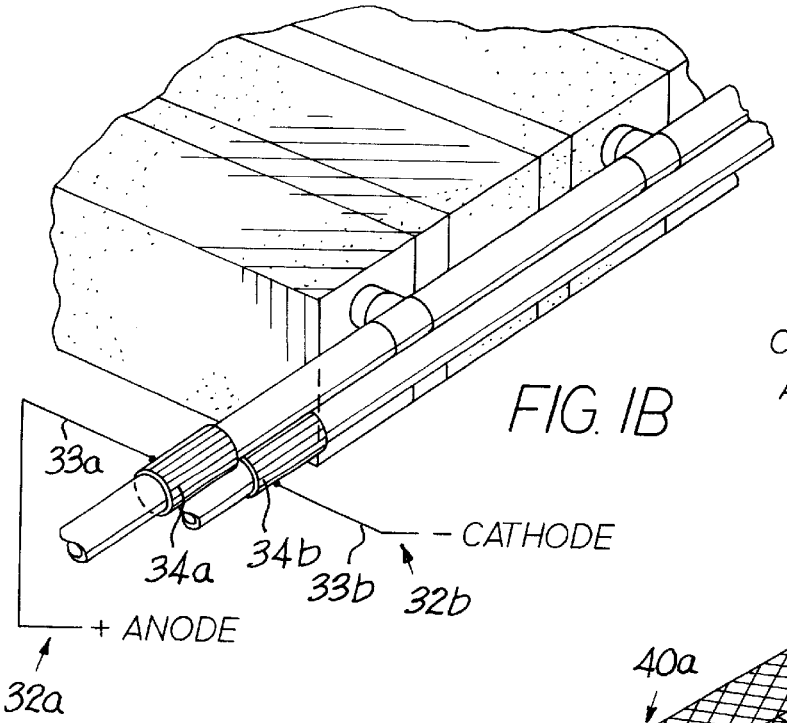
FIGS. 1B and 1C illustrate electrode configurations for supplying positive and negative charges to the electrolytic fluid, according to the present invention.

According to one embodiment, illustrated in FIG. 1B, means for applying an electrical charge to the electrolytic fluid comprises a positive electrode 32*a* and a negative electrode 32*b*. Positive electrode 32*a* comprises a conductive collar 34*a* configured to surround, in close contact, a portion of the first manifold 60*a*. An electrically conductive wire 33*a* connects the collar 34*a* to the anode. Negative electrode 32*b* comprises a conductive collar 34*b* configured to surround, in close contact, a portion of the second manifold 60*b*. An electrically conductive wire 33*b* connects the collar 34*b* to the cathode. Preferably, the collars 34*a*,34*b* have a cylindrical configuration with an inside diameter equal to or slightly larger than the outside diameter of each manifold 60*a*,60*b*. In addition, it is preferable that the collars 34*a*,34*b* are formed from stainless steel. Even more preferable is 316 stainless steel. Preferably, each electrically conductive wire 33*a*,33*b* is insulated to protect against electrical shock. The portion of each collar 34*a*,34*b* to which each respective wire 33*a*,33*b* is attached, preferably has silicone rubber applied thereto and is encased within heat shrink tubing to protect the wire-to-collar connection. Preferably, each electrically conductive wire 33*a*,33*b* is sufficiently flexible to permit the apparatus 10 to achieve virtually any orientation and position during decontamination operations. In an alternative embodiment, the electrodes may be located within the respective electrolyte reservoirs, letting the electrolyte act as the electrical conductor.

Figure 1C:
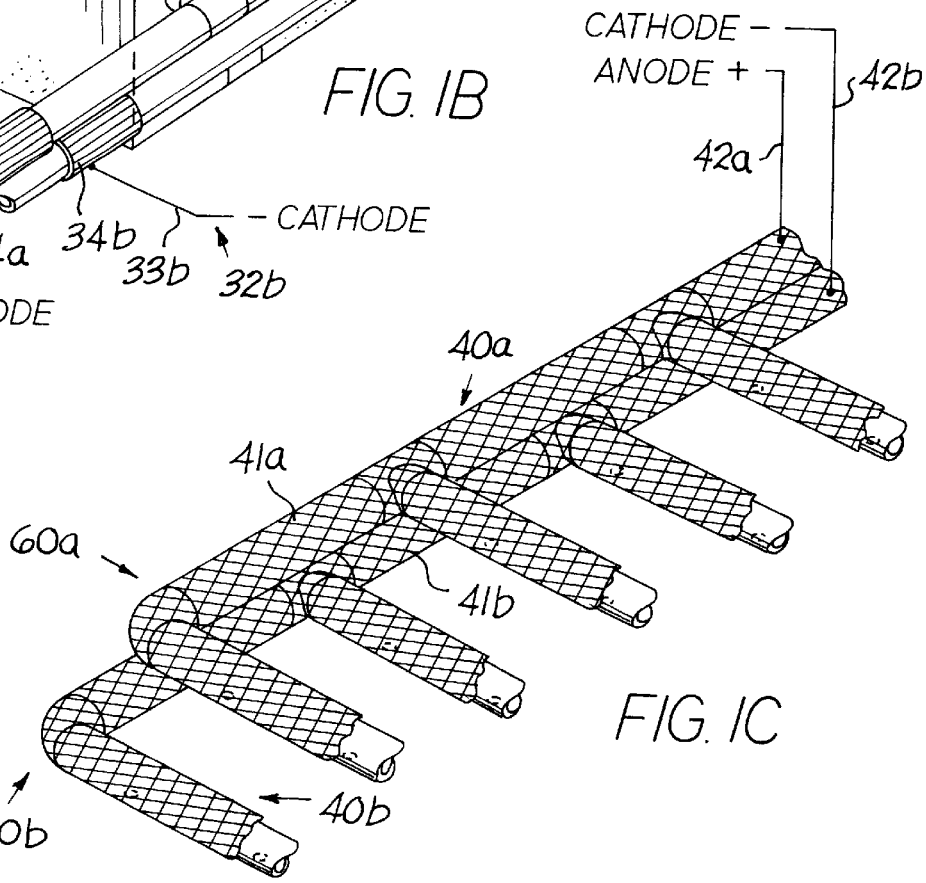

According to another embodiment, illustrated in FIG. 1C, means for applying an electrical charge to the electrolytic fluid comprises a positive electrode 40*a* and a negative electrode 40*b*. Positive electrode 40*a* comprises an electrically conductive wire braiding 41*a* surrounding, and in close contact with the first manifold 60*a*. An electrically conductive wire 42*a* connects the wire braiding 41*a* to the anode. Negative electrode 40*b* comprises an electrically conductive wire braiding 41*b* surrounding, and in close contact with the second manifold 60*b*. An electrically conductive wire 42*b* connects the wire braiding 41*b* to the cathode.

Preferably, the wire braiding 41*a*,41*b* is adhesively bonded to each respective manifold 60*a*,60*b*. In addition, it is preferable that the wire braiding 41*a*,41*b* is formed from stainless steel. Even more preferable is 316 stainless steel. Preferably, each electrically conductive wire 42*a*,42*b* is insulated to protect against electrical shock. The portion of each wire braid 41*a*,41*b* to which each respective wire 42*a*,42*b* is attached, preferably has silicone rubber applied thereto and is encased within heat shrink tubing to protect the wire-to-braid connection. Preferably, each electrically conductive wire 42*a*,42*b* is sufficiently flexible to permit the apparatus 10 to achieve virtually any orientation and position during decontamination operations.

Figure 3:
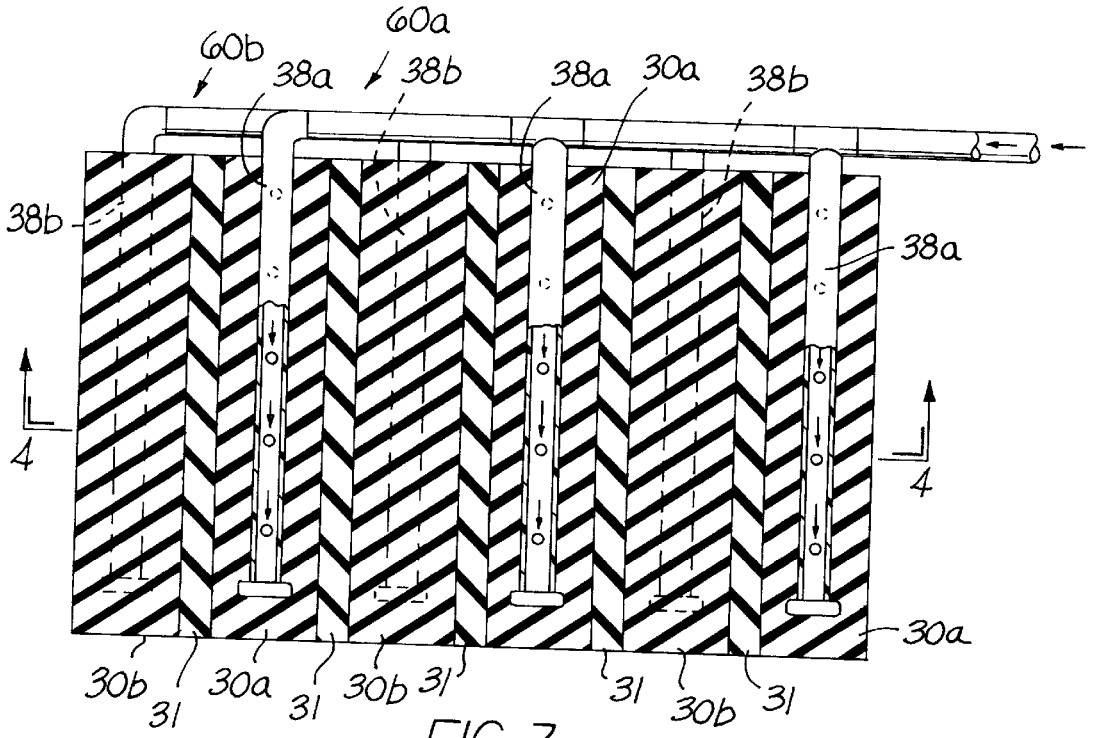
FIG. 3 is a cross-sectional view taken along lines 3—3 in FIG. 1.
Figure 4:
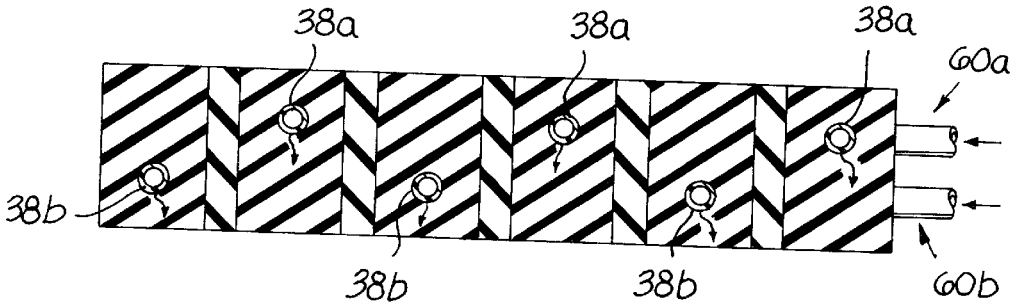
FIG. 4 is a cross-sectional view taken along lines 4—4 in FIG. 3.

Referring now to FIGS. 3 and 4, each one of the first and second applicators 30*a*,30*b* comprises an internal bore 38*a*, 38*b* configured to receive a respective first or second fluid discharge line 64*a*,64*b*. A first electrolytic fluid 39*a*, having a positive electrical charge, flows through the first fluid manifold 60*a* and through each first fluid discharge line 64*a* and exits through the plurality of orifices 68*a*, thereby wetting each first applicator 30*a*. Similarly, a second electrolytic fluid 39*b*, having a negative electrical charge, flows through the second fluid manifold 60*b* and through each first fluid discharge line 64*b* and exits through the plurality of orifices 68*b*, thereby wetting each second applicator 30*b*.

In the illustrated embodiment, the applicators have a generally parallel configuration and a generally rectangular cross-section. Each one of the first and second applicators 30*a*,30*b* are preferably formed from an open-cell material, for example sponge, to permit fluid to flow through the applicator to the surface being decontaminated. However, as would be understood by those having skill in the art, the first and second applicators 30*a*,30*b* may be formed from any liquid-permeable material that can adequately transfer fluid to a surface being decontaminated. Preferably, the liquid-permeable material should have good absorbency characteristics. Additionally, it is preferable that the material from which the first and second applicators 30*a*,30*b* are formed have sufficient rigidity to prohibit excessive deformation during usage. Excessive deformation may result in contact between adjacent first and second applicators 30*a*,30*b*, thereby shorting out the electrical circuit between each respective pair of applicators. Furthermore, excessive deformation may result in inadequate transfer of fluid to the surface being decontaminated.

Each pair of first and second applicators 30*a*,30*b* includes a non-conductive divider 31 in order to prevent contact between the respective first and second applicators. Each one of the dividers 31 is preferably formed from a closed-cell material to inhibit the flow of electrolytic fluid between applicators positioned on either side, and to prohibit absorbing any fluid from a surface being decontaminated.

The first and second electrolytic fluids 39*a*,39*b* are delivered from external fluid reservoirs (not shown) to each one of the respective first and second fluid manifolds 60*a*,60*b* via the first and second fluid supply lines 62*a*,62*b*. The flowrate may vary depending on the size and configuration of the applicators 30*a*,30*b* utilized. Preferably, the flowrate should be sufficient to keep each applicator saturated. Also, the flowrate and pressure of the first and second electrolytic fluids 39*a*,39*b* may be controlled via a system of pumps and valves (not shown). Exemplary pumps for this purpose include peristaltic pumps, variable speed pumps, and other positive displacement pumps. Particularly preferable are peristaltic pumps having a two-tube pump head (one tube for each electrolyte channel) and controlled via an on-off switch and a voltage controller. Each pump head comprises a roller for squeezing the electrolyte fluid through the tubes. This configuration allows the pumping rate to be varied to maintain a saturated, but not supersaturated, sponge applicator. Valves are not necessary with this configuration.

As would be understood by those having skill in the art, other means of providing first and second fluids 39*a*,39*b* to each respective first and second applicator 30*a*,30*b* may be utilized, including gravity. For example, two centrifugal pumps including by-pass lines and throttle valves could be used to control the feed rate of electrolyte fluid through each manifold 60*a*,60*b*.

Preferably, both the first and second fluid supply lines 62*a*,62*b*, and both the first and second fluid manifolds 60*a*,60*b* are flexible and permit the apparatus 10 to bend and flex as desired to conform with the surface being decontaminated. Exemplary fluid supply lines and fluid manifolds include plastic tubing, rubber tubing, and the like. Preferably the fittings used to connect portions of the fluid supply lines 62*a*,62*b* and fluid manifolds 60*a*,60*b* are pressure-fit and require no clamps or other means to secure the flexible fluid supply lines and fluid manifolds thereto and to form a leak-proof connection.

Figure 2:
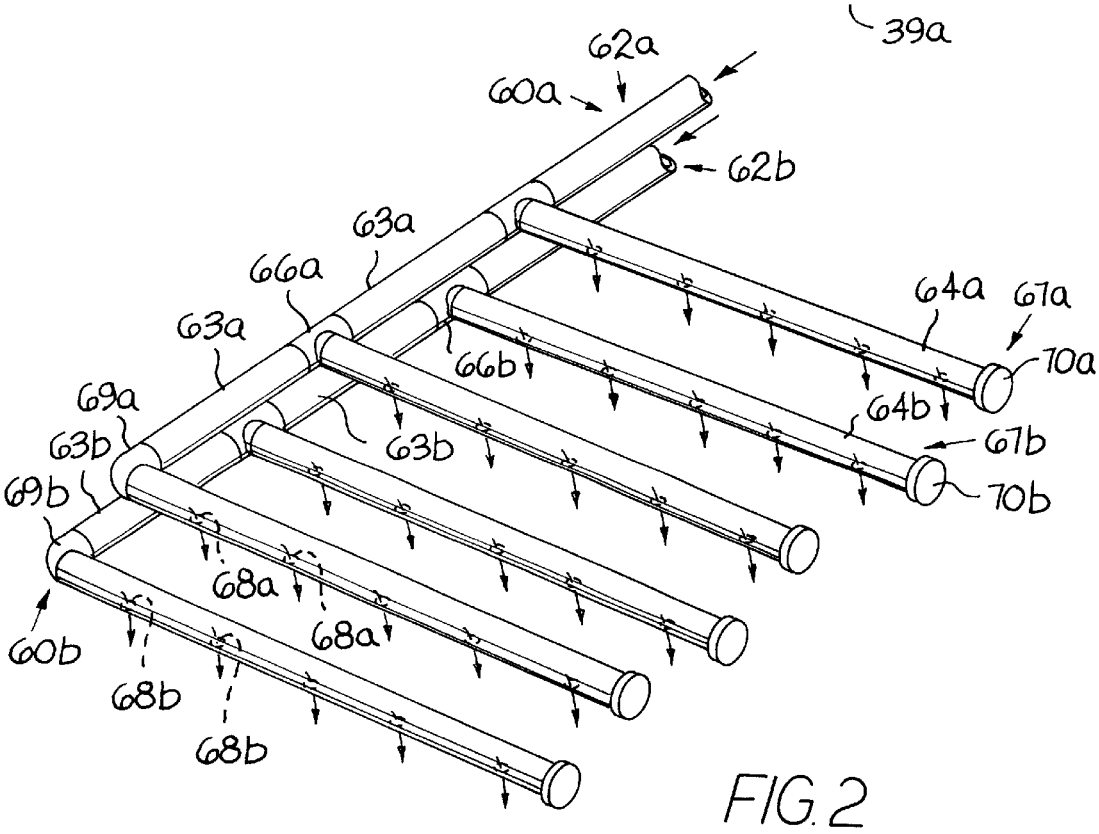
FIG. 2 is a perspective view of the fluid manifolds, according to the present invention.

Referring back to FIG. 2, the first and second fluid manifolds 60*a*,60*b* are described in greater detail. The first fluid manifold 60*a* comprises a plurality of discharge lines 64*a* in fluid communication with a first fluid delivery line

62*a*. In the illustrated embodiment, the first fluid delivery line 62*a* comprises a plurality of tubing sections 63*a* joined together via tees 66*a*, and a 90° elbow 69*a*. A discharge line 64*a* branches from the first fluid delivery line 62*a* at each tee 66*a*, and at the 90° elbow. However, as would be understood by those having skill in the art, any configuration of tubing sections 63*a* and fittings may be used to accommodate the location of each discharge line 64*a* within each respective applicator 30*a*.

Similarly, the second fluid manifold 60*b* comprises a plurality of discharge lines 64*b* in fluid communication with a second fluid delivery line 62*b*. In the illustrated embodiment, the second fluid delivery line 62*b* comprises a plurality of sections 63*b* joined together via tees 66*b*, and a 90° elbow 69*b*. A discharge line 64*b* branches from the second fluid delivery line 62*b* at each tee 66*b*, and at the 90° elbow 69*b*. However, as would be understood by those having skill in the art, any configuration of sections 63*b* and fittings may be used to accommodate the location of each discharge line 64*b* within each respective applicator 30*b*.

Preferably, each discharge line 64*a*,64*b* comprises a plurality of spaced apart orifices 68*a*,68*b* through which the first and second fluid passes to wet each respective applicator 30*a*,30*b* positioned thereon. The orifices 68*a*,68*b* may be oriented longitudinally along the same line, or may have any annular orientation desirable, including being oriented in opposing directions. As shown in FIG. 4, the desirable direction for the respective first and second fluids to migrate, is in a direction generally towards one of the surfaces of the apparatus 10. The end portion 67*a*,67*b* of each discharge line 64*a*,64*b* is preferably fitted with a plug 70*a*,70*b*. The first and second fluid manifolds 60*a*,60*b* may comprise any number of discharge lines 64*a*,64*b* and may have any configuration desirable, depending on the number, size, configuration, and orientation of the first and second applicators 30*a*,30*b*. Alternatively, permeable tubes may be used instead of solid-wall tubes with orifices, as in the illustrated embodiment.

As is understood by those having skill in the art, an electrolytic fluid is a solution comprising a chemical compound that will conduct an electric current. Acids, bases, and salts, when dissolved in water or a nonaqueous solvent, become electrolytic fluids. Particularly preferable electrolytic fluids, according to the present invention, include chelating agents having high conditional stability constants for the radionuclides/contaminants to be removed in the 6.0 to 8.0 pH range. Preferably, chelating agents comprising blends of carboxylic acid and aminopolycarboxylic acid salts in the 6.0 to 8.0 pH range are used. Even more preferably is a pH range of 6.5 to 7.5; however, chelants within the range of 1.0 to 14 pH may be employed.

In the illustrated embodiment, the apparatus 10 comprises three pairs of first and second applicators 30*a*,30*b*. However, only one pair of first and second applicators 30*a*,30*b* are required for the present invention to remove contamination from a surface. The number of pairs of first and second applicators 30*a*,30*b* is optional and is dependent on the apparatus 10 configuration, the type of decontamination effort involved, decontamination efficiencies, and other factors that are user and task-dependent. The apparatus 10 is preferably sized and configured to be hand-held and easily manipulated by decontamination personnel. However, the apparatus 10 may have any size and shape desirable for decontaminating surfaces, and is not limited to a hand-held device. Also, the configuration of the first and second applicators 30*a*,30*b* is not limited to the illustrated configuration.

The first and second applicators 30*a*,30*b* may be concentrically configured, for example, or may have various other non-parallel configurations. Furthermore, each applicator may have other cross-sectional shapes, including square, rounded, V-shaped, U-shaped, and the like. The apparatus 10, according to the present invention, may have a cylindrical configuration so as to be capable of cleaning the inside surfaces of pipes. In addition, the apparatus 10, according to the present invention, may have a cylindrical configuration with a passageway therethrough so as to be capable of cleaning the outside surfaces of pipes. In both of these embodiments, the applicator and pipe are moved relative to one another.

Returning now to FIGS. 1B and 1C, each one of the electrodes 32*a*,32*b* and 40*a*,40*b* are connected to a power source (not shown) via electrical wires 33*a*,33*b* and 42*a*, 42*b*, respectively. Preferably, the power source comprises means for monitoring and adjusting voltage and current flow. The power source should be capable of producing a voltage potential between each pair of first and second applicators 30*a*,30*b* of between about 2 and 24 volts. An exemplary power source is a Model D-612T DC power supply manufactured by EPSCO Inc. A voltage range of about 0 to 24 volts, and an amperage range of about 0 to 15 amps are acceptable. Electrical wires 33*a*,33*b* and 42*a*,42*b* are preferably flexible 12 gauge electrically insulated wire. Conventional connectors may be used to connect each electrical wire with the power source and with respective collars 34*a*,34*b* (FIG. 1B) and wire braid 41*a*,41*b* (FIG. 1C). Alternatively, solder or conductive adhesives may be used to connect each electrical wire with the power source and with respective collars 34*a*,34*b* (FIG. 1B) and wire braid 41*a*,41*b* (FIG. 1C). As would be understood by those having skill in the art, conventional means for monitoring and adjusting electrical voltage and current flow may be utilized, including voltmeters, ammeters, potentiometers, and the like.

A primary concern is to keep electrical voltage and current flow below certain levels in order to reduce the risk of electrical shock to personnel handling the apparatus 10 during operation. Preferable voltages are between about 2 and 24 volts. In order to achieve effective decontamination, yet keep the voltage within a range of about 2 and 24 volts, each one of a pair of first and second applicators 30*a*,30*b* needs to be relatively close together. Preferably, each one of a pair of applicators should be separated by a distance of no more than about one quarter inch (¼"). However, as would be understood by those having skill in the art, the distance between first and second applicators in a pair is dependent on the size of each applicator as well as the configuration of each set of pairs of applicators and the voltage and current utilized.

The method of decontamination, according to the present invention, can be characterized as "reverse electroplating." Electroplating involves the electrochemical deposition of a thin layer of metal on a conductive surface. Electroplate coatings are typically applied for decorative and/or corrosion-inhibiting purposes. The electroplating process consists essentially of connecting the surface to be plated to the negative terminal of a direct-current power source, and another piece of metal to the positive terminal, and then immersing both parts in an electrolytic fluid. The surface connected to the negative terminal becomes the cathode, and the other metal part connected to the positive terminal becomes the anode. Metal dissolves at the anode and is plated at the cathode via chemical reactions known as electrolysis. (See, *Electroplating of Metals*, Vol. 6, McGraw-Hill Encyclopedia of Science & Technology, 7th Edition, p. 261, 1992).

In general, radioactive contamination is present on equipment exposed to radioactivity in the above-described environments in the form of a thin layer of radioactive oxide. In the embodiment illustrated in FIG. 1, the first set of applicators 30*a* have a positive charge, and effectively act as anodes. Correspondingly, the second set of applicators 30*b* have a negative charge, and effectively act as cathodes. However, this configuration can be reversed wherein the first set of applicators 30*a* act as cathodes and the second set of applicators 30*b* act as anodes. When the radioactive oxide layer is contacted by a pair of first and second applicators 30*a*,30*b* containing respective first and second electrolytic fluids 39*a*,39*b* having respective positive and negative charges, the layer of oxide is "plated" onto the applicators acting as cathodes. When the apparatus 10 is moved in a wiping motion over the surface, the absorbent nature of the applicator material facilitates the removal of the oxide layer from the surface. Furthermore, the absorbent nature of the applicator material facilitates the decontamination of vertical surfaces by keeping the electrolytic fluids from being applied in excessive amounts.

According to another aspect of the present invention, the apparatus 10 may comprise means for removing fluid from a surface being decontaminated via a vacuum manifold constructed of electrically non-conductive material. As would be known to those having skill in the art, valves and filters may be utilized to control the flow and to remove any contaminants from the fluids prior to reuse. Additionally, recirculation may be achieved via gravity or via pumping means. This embodiment is advantageous in that, with sufficient electrolyte delivery and return, non-conductive/nonionic particulate material may be removed.

According to another embodiment of the present invention, each one of the first set of applicators 30*a* has an electrode in electrical contact therewith. Similarly, each one of the second set of applicators 30*b* has an electrode in electrical contact therewith. The electrodes are configured such that the first and second electrolytic fluids 39*a*,39*b*, flowing from respective first and second discharge lines 64*a*,64*b* are not obstructed from sufficiently wetting the respective first and second applicators 30*a*,30*b*. As those having skill in the art would understand, an electrode may be electrically connected with a respective applicator by inserting the electrode within the applicator, or by contacting other portions of the outer surface of an applicator. Furthermore, a plurality of electrodes may be used with each applicator as long as each electrode for a given applicator has the same polarity electrical current running therethrough.

Figure 5:
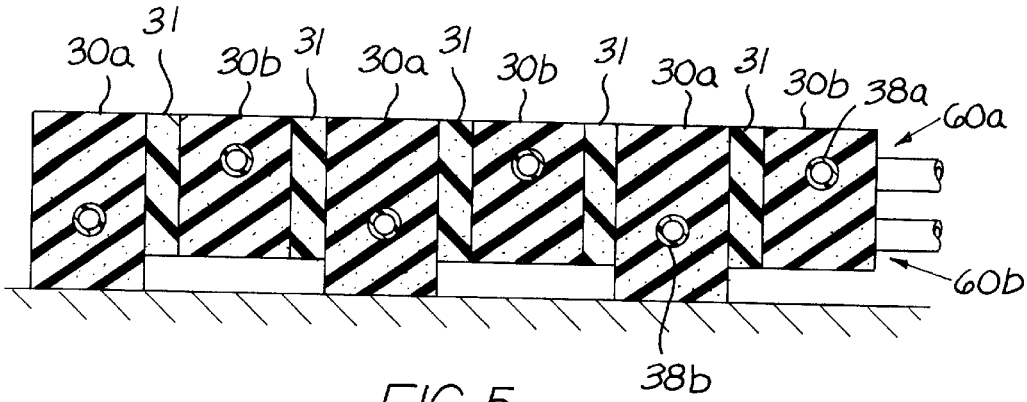
FIG. 5 illustrates a configuration of applicators wherein each cathodic applicator is recessed from the surface being decontaminated.

According to another embodiment of the present invention, illustrated in FIG. 5, the anodic applicators 30*a* are configured to contact the surface to be decontaminated, while the cathodic applicators 30*b* are configured not to make contact. As a result, more contaminated surface area can be exposed to the underside portion of the cathodic applicator.

An advantage of the methods and apparatus herein disclosed is that both conductive and non-conductive surfaces can be quickly and easily decontaminated. For example, the present invention may be used to decontaminate concrete surfaces in addition to metal surfaces. Another advantage is that both porous and smooth surfaces can be effectively decontaminated. Yet another advantage of the present invention is that a variety of types of contamination can be removed from surfaces. The present invention is not limited to removal of radioactive contamination.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. An apparatus for decontaminating surfaces having contamination thereon, comprising:

at least one pair of first and second applicators spaced apart by a first insulating member positioned therebetween, said first and second applicators configured to receive respective first and second fluids and transfer said first and second fluids to a contaminated surface, said first insulating member configured to electrically insulate said first and second applicators, and being impermeable to said first and second fluids;

a first electrode electrically connected with said first applicator for supplying electric current of a first polarity between said first electrode and said first applicator; and a second electrode electrically connected with said second applicator for drawing electric current of a second polarity between said second electrode and said second applicator.

2. An apparatus according to claim 1, wherein said at least one pair of first and second applicators comprises a plurality of pairs of first and second applicators, each one of said pairs spaced apart by a second insulating member positioned therebetween and configured to electrically insulate each one of said pairs, and being impermeable to said first and second fluids.

3. An apparatus according to claim 2, wherein each one of said second insulating members prevents contact between each one of said pairs of first and second applicators during the decontamination of a surface.

4. An apparatus according to claim 1, wherein said first insulating member prevents contact between said first and second applicators during the decontamination of a surface.

5. An apparatus according to claim 1, wherein said first and second applicators are formed of a material permeable by said respective first and second fluids.

6. An apparatus according to claim 1, wherein each one of said first and second electrodes are embedded within a respective one of said first and second applicators.

7. An apparatus according to claim 1, wherein said first electrode is an anode.

8. An apparatus according to claim 1, wherein said second electrode is a cathode.

9. An apparatus according to claim 1, wherein each one of said first and second applicators comprises an internal bore including an aperture sized and configured to receive respective first and second fluid delivery means.

10. An apparatus according to claim 1, wherein said first and second applicators are configured such that when said first applicator is in operative contact with a surface being decontaminated, said second applicator is not in contact with said surface.

11. An apparatus for decontaminating surfaces having contamination thereon, comprising:

at least one pair of first and second applicators spaced apart by a first insulating member positioned therebetween, said first and second applicators configured to receive respective first and second fluids having respective first and second electrical polarities, and to transfer said first and second fluids to a contaminated surface, said first insulating member configured to electrically insulate said first and second applicators, and being impermeable to said first and second fluids.

12. An apparatus according to claim 11, wherein said at least one pair of first and second applicators comprises a plurality of pairs of first and second applicators, each one of said pairs spaced apart by a second insulating member positioned therebetween and configured to electrically insulate each one of said pairs, and being impermeable to said first and second fluids.

13. An apparatus according to claim 12, wherein each one of said second insulating members prevents contact between each one of said pairs of first and second applicators during the decontamination of a surface.

14. An apparatus according to claim 11, wherein said first insulating member prevents contact between said first and second applicators during the decontamination of a surface.

15. An apparatus according to claim 11, wherein said first and second applicators are formed of a material permeable by said respective first and second fluids.

16. An apparatus according to claim 11, wherein said first applicator is an anode.

17. An apparatus according to claim 11, wherein said second applicator is a cathode.

18. An apparatus according to claim 11, wherein each one of said first and second applicators comprises an internal bore including an aperture located and configured to receive respective first and second fluid delivery means.

19. A system for decontaminating surfaces having contamination thereon, comprising:

at least one pair of first and second applicators spaced apart by a first insulating member positioned therebetween, said first and second applicators configured to receive respective first and second fluids and transfer said first and second fluids to a contaminated surface, said first insulating member configured to electrically insulate said first and second applicators, and being impermeable to said first and second fluids;

a first electrode electrically connected with said first applicator for supplying electric current of a first polarity between said first electrode and said first applicator;

a second electrode electrically connected with said second applicator for drawing electric current of a second polarity between said second electrode and said second applicator;

first fluid delivery means in fluid communication with said first applicator;

second fluid delivery means in fluid communication with said second applicator; and power supply means for supplying electric current of a first polarity to said first electrode, and for drawing electric current of a second polarity from said second electrode.

20. A system according to claim 19, wherein each one of said first and second applicators comprises an internal bore including an aperture located and configured to receive respective first and second fluid delivery means.

21. A system according to claim 19, further comprising a first fluid source and wherein said first fluid delivery means comprises a pump for delivering said first fluid from said first fluid source to said first applicator.

22. A system according to claim 21, wherein said first fluid is delivered to said first applicator via tubing inserted into said internal bore via said aperture.

23. A system according to claim 19, further comprising a second fluid source and wherein said second fluid delivery means comprises a pump for delivering said second fluid from said second fluid source to said second applicator.

24. A system according to claim 23, wherein said second fluid is delivered to said second applicator via tubing inserted into said internal bore via said aperture.

25. A system according to claim 19, wherein said first and second fluids are conductive electrolytic fluids selected from the group consisting of acids, bases, and salts.

26. A system according to claim 19, wherein said power supply means creates an electrical potential between said first and second applicators between about 2 volts and about 24 volts.

27. A system according to claim 19, wherein said at least one pair of first and second applicators comprises a plurality of pairs of first and second applicators, each one of said pairs spaced apart by a second insulating member positioned therebetween and configured to electrically insulate each one of said pairs, and being impermeable to said first and second fluids.

28. A system according to claim 27, wherein each one of said second insulating members prevents contact between each one of said pairs of first and second applicators during the decontamination of a surface.

29. A system according to claim 19, wherein said first insulating member prevents contact between said first and second applicators during the decontamination of a surface.

30. A system according to claim 19, wherein said first and second applicators are formed of a material permeable by said respective first and second fluids.

31. A system according to claim 19, wherein each one of said first and second electrodes are embedded within a respective one of said first and second applicators.

32. A system according to claim 19, wherein said first electrode is an anode.

33. A system according to claim 19, wherein said second electrode is a cathode.

34. A system according to claim 19, wherein the contaminated surface comprises radioactive contamination.

35. A system for decontaminating surfaces having contamination thereon, comprising:

at least one pair of first and second applicators spaced apart by a first insulating member positioned therebetween, said first and second applicators configured to receive respective first and second fluids having respective first and second electrical polarities, and to transfer said first and second fluids to a contaminated surface, said first insulating member configured to electrically insulate said first and second applicators, and being impermeable to said first and second fluids;

first fluid delivery means in fluid communication with said first applicator;

second fluid delivery means in fluid communication with said second applicator; and power supply means for supplying electric current of a first polarity to said first fluid, and for drawings electric current of a second polarity from said second fluid.

36. A system according to claim 35, wherein each one of said first and second applicators comprises an internal bore including an aperture located and configured to receive respective first and second fluid delivery means.

37. A system according to claim 35, further comprising a first fluid source and wherein said first fluid delivery means comprises a pump for delivering said first fluid from said first fluid source to said first applicator.

38. A system according to claim 37, wherein said first fluid is delivered to said first applicator via tubing inserted into said internal bore via said aperture.

39. A system according to claim 35, further comprising a second fluid source and wherein said second fluid delivery means comprises a pump for delivering said second fluid from said second fluid source to said second applicator.

40. A system according to claim 39, wherein said second fluid is delivered to said second applicator via tubing inserted into said internal bore via said aperture.

41. A system according to claim 35, wherein said first and second fluids are conductive electrolytic fluids selected from the group consisting of acids, bases, and salts.

42. A system according to claim 35, wherein said power supply means creates an electrical potential between said first and second fluids between about 2 volts and about 24 volts.

43. A system according to claim 35, wherein said at least one pair of first and second applicators comprises a plurality of pairs of first and second applicators, each one of said pairs spaced apart by a second insulating member positioned therebetween and configured to electrically insulate each one of said pairs, and being impermeable to said first and second fluids.

44. A system according to claim 43, wherein each one of said second insulating members prevents contact between each one of said pairs of first and second applicators during the decontamination of a surface.

45. A system according to claim 35, wherein said first insulating member prevents contact between said first and second applicators during the decontamination of a surface.

46. A system according to claim 35, wherein said first and second applicators are formed of a material permeable by said respective first and second fluids.

47. A system according to claim 35, wherein said first applicator is an anode.

48. A system according to claim 35, wherein said second applicator is a cathode.

49. A system according to claim 35, wherein the contaminated surface comprises radioactive contamination.

* * * * *